United States Patent [19]

Kohler et al.

[11] Patent Number: 4,513,915

[45] Date of Patent: Apr. 30, 1985

[54] NOZZLE CONSTRUCTION FOR COATING EQUIPMENT

[75] Inventors: Gordon A. E. Kohler; John B. Kohler, both of North Canton; Herbert B. Kohler, Greentown, all of Ohio

[73] Assignee: The Kohler Coating Machinery Corporation, Greentown, Ohio

[21] Appl. No.: 447,103

[22] Filed: Dec. 6, 1982

[51] Int. Cl.[3] ..... B05B 1/04; B05B 1/32

[52] U.S. Cl. ..... 239/455; 239/590.3; 239/592; 118/63

[58] Field of Search ..... 239/590.3, 592, 594, 239/455; 118/62, 63

[56] References Cited

U.S. PATENT DOCUMENTS

| | | | |
|---|---|---|---|
| 2,766,720 | 10/1956 | Moller et al. | 118/63 |
| 2,940,418 | 6/1960 | Penrod et al. | 118/63 |
| 2,981,223 | 4/1961 | Olszowka | 118/63 |
| 2,981,224 | 4/1961 | Phelps | 118/63 |
| 3,141,194 | 7/1964 | Jester | 425/404 |
| 3,314,163 | 4/1967 | Kohler | 34/155 |
| 4,106,429 | 8/1978 | Phillips | 118/63 |
| 4,261,117 | 4/1981 | van der Peyl | 239/455 X |
| 4,359,964 | 11/1982 | Johnson | 118/68 |
| 4,417,540 | 11/1983 | Wohlfeil | 118/63 |

*Primary Examiner*—Andres Kashnikow
*Assistant Examiner*—Kevin Patrick Weldon
*Attorney, Agent, or Firm*—Michael Sand Co.

[57] ABSTRACT

An improved nozzle of the type which directs a flow of fluid against a moving substrate to obtain a uniform surface coating on the substrate. The nozzle consists of two rigid body halves mounted on a fluid feed pipe. One body half is fixed, and the other body half is rotatably mounted on the feed pipe for adjusting the size of the nozzle discharge opening. One or more closure loading assemblies are mounted on the nozzle for adjusting the size of the discharge opening and for maintaining the nozzle opening in an adjusted position. Each closure loading assembly has a fluid-actuated cylinder which forces the body halves toward a closed position opposing the internal fluid pressure in the nozzle body in combination with an adjustable differential screw. The adjustable screw is mounted on one of the body halves and engages a stop on the other body half to set the size of the nozzle discharge opening. The closure-loading assemblies will maintain the adjusted nozzle opening even after opening and closing of the nozzle for cleaning and will permit adjustment of the discharge opening during operation of the nozzle. The feed pipe is connected to a source of fluid and distributes the coating control fluid throughout the length of the nozzle through a plurality of spaced holes formed in the feed pipe and nozzle body halves. Each closure loading assembly and stop screw effectively acts in a common plane perpendicular to the transversely extending fluid feed pipe.

24 Claims, 11 Drawing Figures

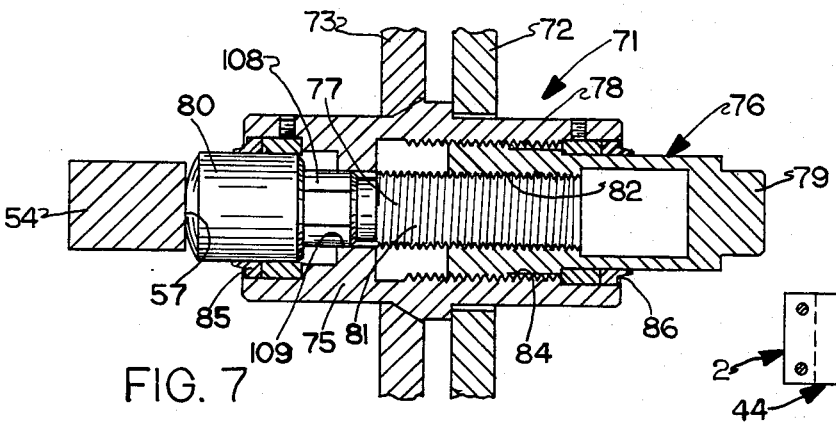
FIG. 7
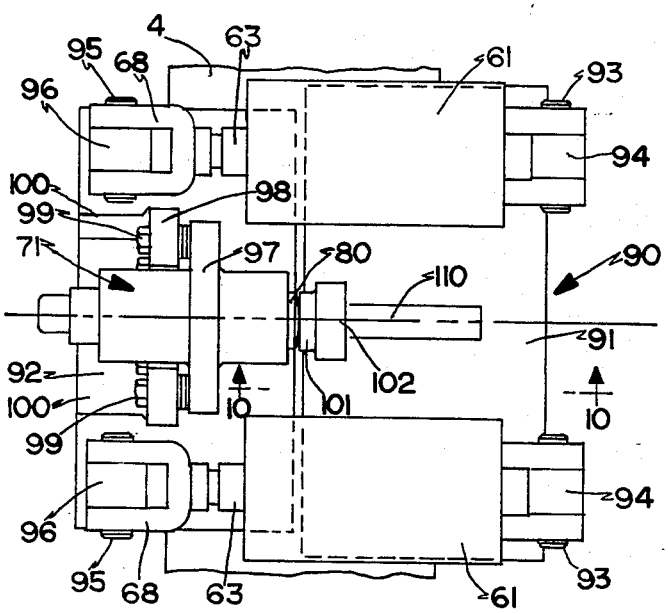
FIG. 8
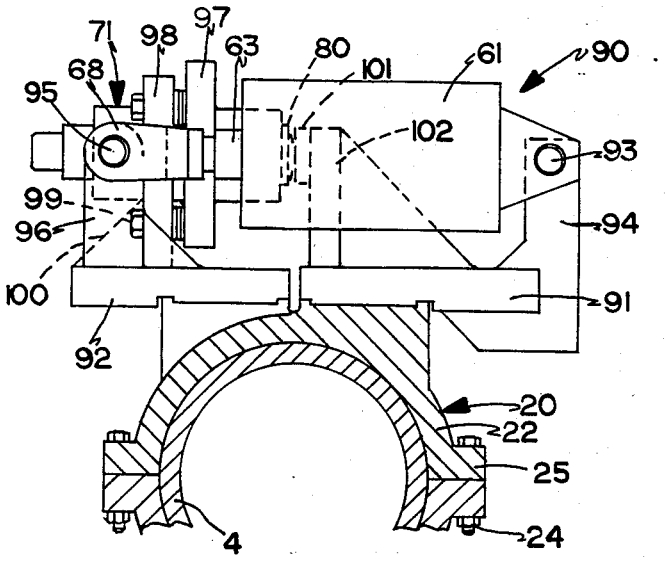
FIG. 9
FIG. 11
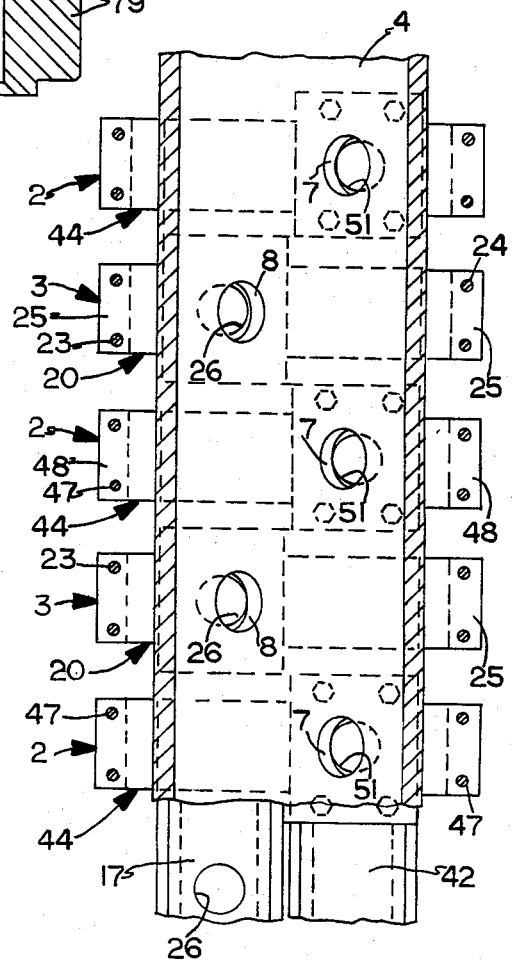
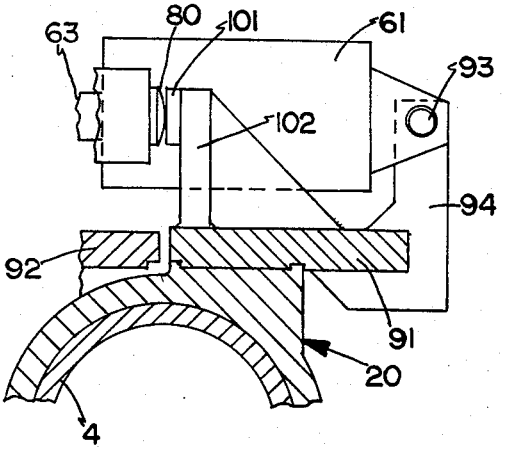
FIG. 10

NOZZLE CONSTRUCTION FOR COATING EQUIPMENT

BACKGROUND OF THE INVENTION

1. Field of the Invention

The invention relates to improvements in nozzle constructions for coating machines and the like. More specifically the invention relates to a fluid nozzle having improved means for supplying the fluid to the nozzle discharge opening and to a mechanism for adjusting and maintaining the size of the nozzle opening at the adjusted position.

2. Description of the Prior Art

Gaseous fluid nozzles have been used in the coating industry for at least two basic functions, the first of which may be classified as "doctoring means," wherein the nozzle jet of fluid, usually gaseous fluid such as air, acts directly on a liquid or semi-liquid material which has been applied as a coating to the surface of a substrate, such as paper, film, foil, cloth or metal strip, in excess immediately ahead of or upstream from the particular nozzle in terms of movement of the substrate relative to the nozzle to reduce the coating to the desired thickness and smoothness.

Another basic use of gaseous fluid nozzles in the strip processing industry is as a "backing means," in which case, the air or other gaseous fluid jet is applied to one side of the moving strip, such as paper or plastic film, to maintain a uniform pressure against an object on the opposite side, such as a cooling roll or a rigid coating knife. One example of this "backing means" use is illustrated in U.S. Pat. No. 3,113,884.

It is not intended to limit the principles of the present invention to the paper coating industry or the coating of substrates of this general type, but rather it is fully contemplated that the principles of the present invention may be applied to nozzles for many uses, some of which may not be presently known.

It also is important that the nozzle opening be uniform within close limits throughout the entire length of the nozzle opening to insure a uniform coating on the moving substrate throughout its width. This can be a problem in many fluid nozzles due to the transverse length of the nozzle opening. Variations in the nozzle opening cause variations in the force output of the jet which produces variations in the coating thickness left on the strip.

It is extremely important in the coating industry that downtime and scrap be kept to a minimum. Since the coating station is usually only one part of a complicated expensive machine with a high rate of production, such as a paper board machine, or a steel galvanizing line, faults such as dirt in the nozzle produce scrap rapidly while stops disrupt many processes and restarting may take many minutes. Since a speck of dirt on or in the nozzle can cause a streak in a 200 inch wide strip running 1000 feet per minute or more, lost time and lost production cannot be tolerated.

With the improved opening style nozzle of this invention, dirt and streak problems can be corrected in seconds if dirt is loose, or may be slightly longer if scrubbing is required, and when the nozzle is restored to service, all settings and adjustments remain unchanged from the previous condition.

These problems have long been recognized and U.S. Pat. Nos. 2,766,720 and 2,981,223 were offered to allow one nozzle subassembly to be quickly substituted for another. However, although these and variations thereon worked, it proved extremely difficult to adjust the two subassemblies to produce the same result, defeating the intended purpose.

In an effort to meet this problem, an opening style nozzle was developed such as shown in U.S. Pat. No. 3,314,163. While many such nozzles have been built and are in use around the world, the clamping means for clamping the nozzle halves together has certain faults, particularly in nozzles having a relatively long length for wide strips. Specifically, the stops which set the nozzle discharge opening are spaced generally at the ends of the nozzle body, while the points at which clamping pressure is applied are spaced between them. This system distorts the nozzle body halves and the lips attached to them, which cause variations in the nozzle discharge opening. These variations depend upon the relation between the force created by the internal pressure of the coating fluid and the clamping pressure, and are therefore difficult to control. The present invention is believed to overcome most of the problems with the type of nozzle construction shown in U.S. Pat. No. 3,314,163.

Another important feature of any coating control nozzle is the means by which the coating control fluid is supplied to the nozzle lips which form the discharge opening. Heretofore, the coating control fluid was supplied by various supply pipes and manifold arrangements for discharge into distribution chambers adjacent the nozzle openings. U.S. Pat. Nos. 2,766,720 and 3,141,194 show a type of fluid supply wherein the fluid is fed to the nozzle discharge opening through the center or axis of a rotatable nozzle.

SUMMARY OF THE INVENTION

Objectives of the invention include providing an improved fluid nozzle construction for coating control equipment of the type in which the nozzle is an opening style nozzle having adjustable stops which set the nozzle discharge opening and having clamping devices which hold the nozzle body halves together and in which these stops and clamping devices act in a common plane perpendicular to the pivot axis therefore having no distorting action on said bodies; and in which the clamping force has no effect whatever on said bodies so long as it exceeds the opposing force due to the internal pressure of the coating control fluid.

Another objective is to provide such an improved nozzle in which the nozzle body is formed by two generally similar body halves which are mounted on a fluid supply feed pipe, with one of the body halves being fixed on the feed pipe and the other nozzle half being pivotally mounted on the feed pipe for movement between a predetermined nozzle open position and closed position, in which the nozzle lips that are mounted on the lower ends of the nozzle halves form an orifice determined by screw adjusting means, and in which closure loading clamping devices are mounted on and engageable with the upper portions of the body halves with the feed pipe being located intermediate of the closure loading devices and nozzle lips providing a clamshell type of opening and closing arrangement for the nozzle.

Another objective is to provide such an improved nozzle in which an increase in internal fluid nozzle pressure will have little effect on the nozzle opening and deflection thereof, as long as the force exerted by the closure loading clamping devices is greater than that exerted by internal nozzle pressure, in which the close spacing of the closure loading clamping devices reduces the distortion of the nozzle bodies and lips which occurs in prior nozzle constructions and in which the size of the nozzle discharge opening is substantially independent of the internal fluid pressure.

Another objective of the invention is to provide such an improved nozzle in which the fluid supply feed pipe forms the pivot member on which one of the nozzle body half sections is rigidly mounted and on which the other half body section is pivotally mounted for regulating the size of the discharge opening, and in which the coating control fluid is fed from the pivot feed pipe through spaced openings formed along the pipe and into distribution chambers formed in the ends of the body sections adjacent the nozzle lips.

Another objective is to provide such an improved opening style nozzle which reduces the downtime required for cleaning out the nozzle, which enables the nozzle to be purged of loose dirt by opening the nozzle a short distance, upon which action loose dirt and clogs may be blown out by the internal fluid pressure, or which enables the nozzle to be retracted for full cleaning upon rotation of the movable nozzle body section to a fully open position, and in which even after a complete or partial opening of the nozzle for cleaning, the nozzle can be returned to its preset discharge opening size without any adjustment or readjustment of the nozzle components; and providing such an improved nozzle construction which eliminates difficulties heretofore encountered, achieves the stated objectives simply and efficiently, and solves problems and satisfies needs existing in the art.

These objectives and advantages are obtained by the improved fluid nozzle construction for coating equipment, the general nature of which may be stated as including a transversely elongated nozzle body having first and second sections forming a transversely elongated discharge opening for discharging a stream of fluid on a moving substrate; transversely extending pivot means for pivotally mounting the first body section with respect to the second body section; closure means operatively engageable with the first body section for moving said first body section with respect to the second body section about the pivot means to vary the size of the discharge opening; adjustable stop means for limiting the pivotal movement of the first body section with respect to the second body section to define the size of the discharge opening; and the closure means and stop means effectively acting in a common plane perpendicular to the transversely extending pivot means.

BRIEF DESCRIPTION OF THE DRAWINGS

A preferred embodiment of the invention, illustrative of the best mode in which applicants have contemplated applying the principles, is set forth in the following description and shown in the drawings and is particularly and distinctly pointed out and set forth in the appended claims.

FIG. 7 is an enlarged sectional view taken on line 7—7, FIG. 5;

FIG. 8 is a top plan view of a modified form of the closure loading assembly;

FIG. 9 is a side elevational view with portions in section, of the modified closure loading assembly of FIG. 8;

FIG. 10 is an enlarged fragmentary sectional view taken on line 10—10, FIG. 8; and FIG. 11 is an enlarged fragmentary sectional view taken on line 11—11, FIG. 5.

Similar numerals refer to similar parts throughout the drawings.

DESCRIPTION OF THE PREFERRED EMBODIMENT

Figure 2:
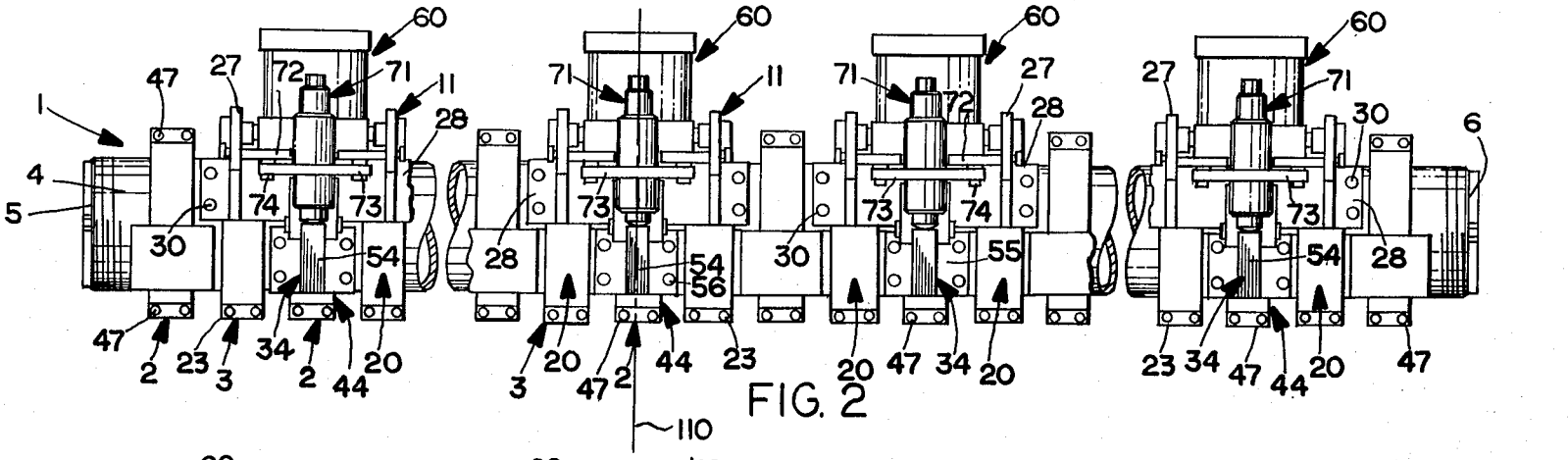
FIG. 2 is a fragmentary top plan view of the improved fluid nozzle construction shown in FIG. 1.
Figure 1:
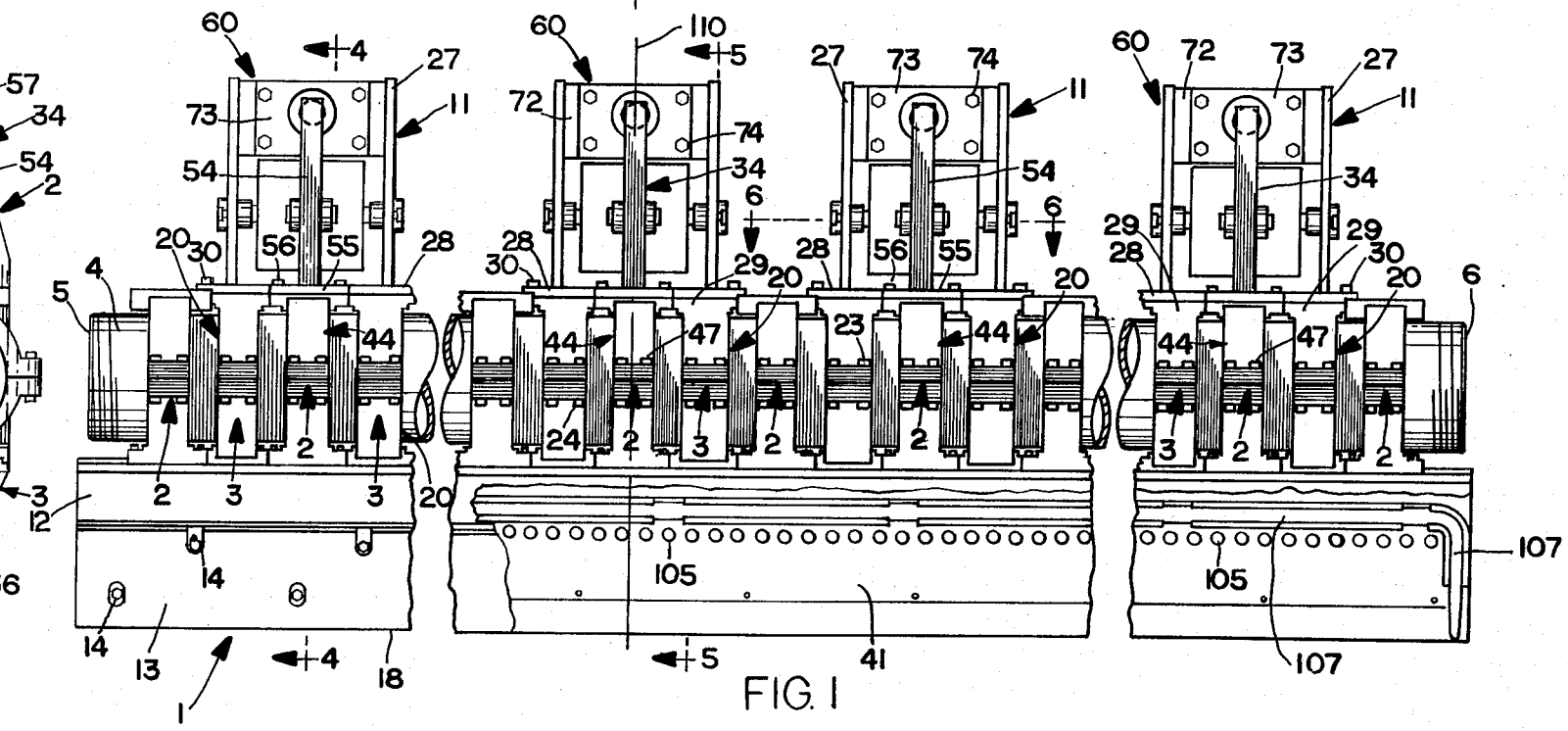
FIG. 1 is a fragmentary front elevational view of the improved fluid nozzle construction with portions broken away and in section.
Figure 3:
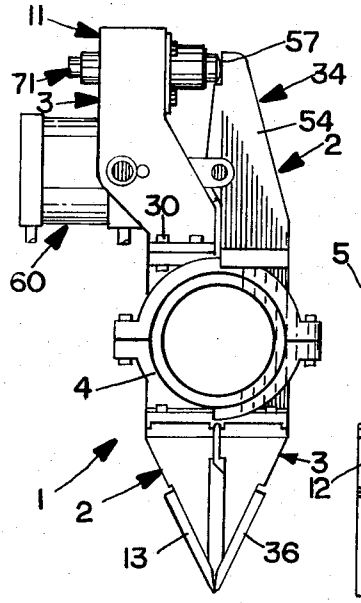
FIG. 3 is a left-hand end elevational view of the fluid nozzle of FIG. 1.
Figures 4, 5, 6:
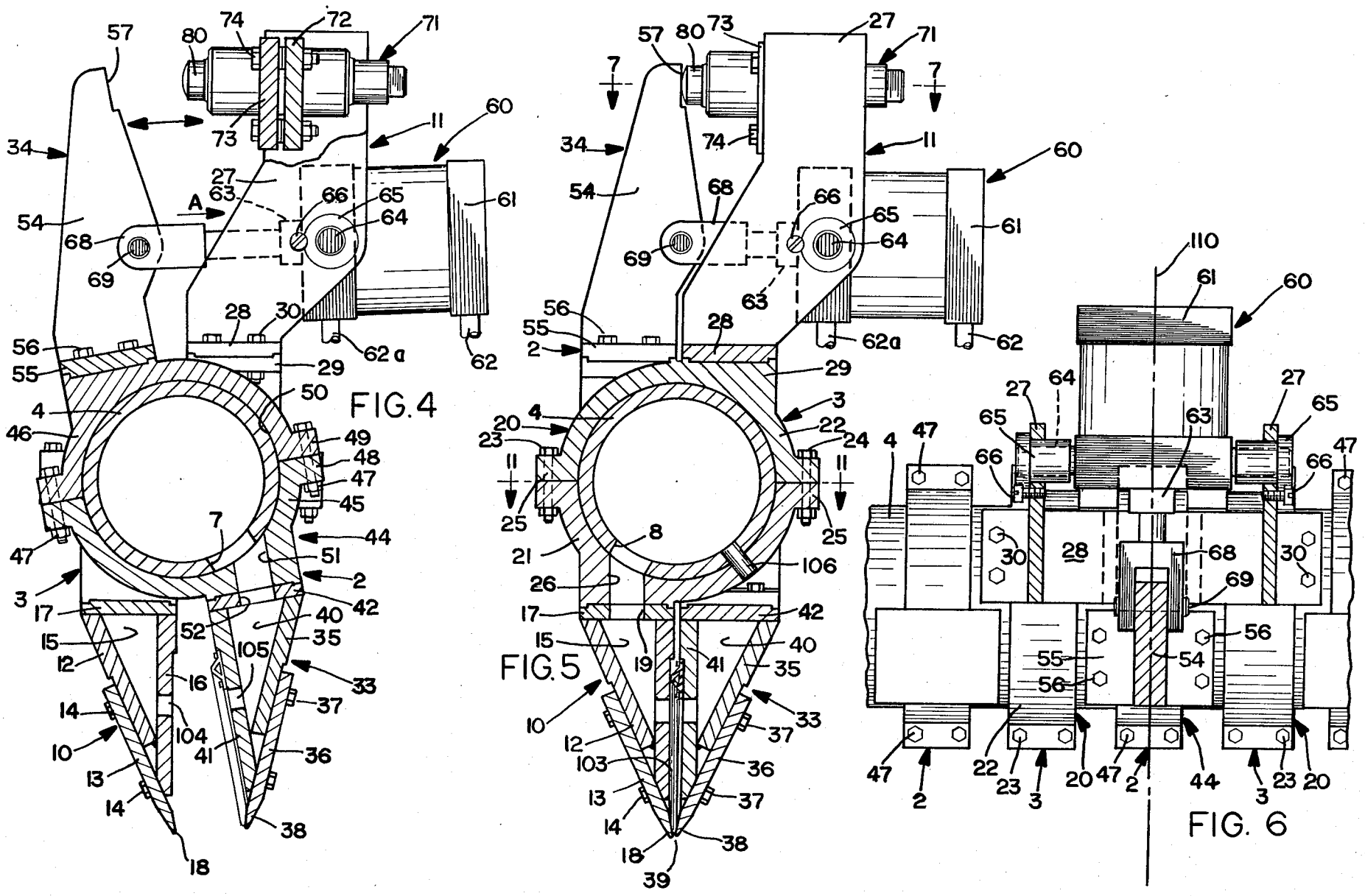
FIG. 4 is an enlarged sectional view taken on line 4—4, FIG. 1, with the nozzle shown in open position.
FIG. 5 is an enlarged sectional view taken on line 5—5, FIG. 1, with the nozzle shown in closed position.
FIG. 6 is an enlarged fragmentary sectional view taken on line 6—6, FIG. 1.

The improved nozzle construction is indicated generally at 1, and is shown in FIGS. 1, 2 and 3 in a fragmentary configuration since the length of the nozzle can vary considerably depending upon the particular application with which it will be used. Improved nozzle 1 includes two half-nozzle body sections indicated generally at 2 and 3, which are mounted on a transversely extending cylindrical fluid feed pipe 4 (FIGS. 3, 4 and 5). Body section 2 is movably mounted on feed pipe 4 with body section 3 being fixed thereon.

Fluid feed pipe 4 extends transversely throughout the length of nozzle 1 and is adapted to be connected to a fluid supply source for feeding the fluid to the nozzle for discharge through a nozzle opening against a moving substrate. Generally the fluid is air and will be supplied to pipe 4 through inlet ends 5 and 6 from a source of compressed air (not shown). Pipe 4 has a plurality of spaced holes 7 and 8 formed throughout the length thereof for communication with nozzle body halves 2 and 3, respectively, as described in greater detail below. The diameter of pipe 4 and the thickness of the cylindrical walls thereof are determined by the particular coating application and use of improved nozzle 1.

Fixed half body section 3 includes a lower fluid distribution chamber portion indicated generally at 10, and an upper closure loading clamping portion indicated generally at 11. Distribution chamber portion 10 (FIGS. 4 and 5) includes a sloped front wall 12 which extends transversely throughout the length of nozzle 1 on which a discharge opening lip wall 13 is attached by a plurality of spaced bolts 14. Front wall 12 forms a hollow transversely extending fluid distribution chamber 15 in combination with an inner wall 16 and an upper wall 17. Lip wall 13 terminates in a lip 18 which forms one side of the nozzle discharge opening.

Distribution chamber portion 10 is fixedly mounted on feed pipe 4 by a plurality of spaced, generally cylindrical-shaped bands indicated generally at 20 (FIG. 5). Each band 20 is formed by two semicylindrical-shaped band sections 21 and 22 connected by bolts 23 and 24 which extend through abutting flanges 25. Band sections 21 and 22 form an inner cylindrical surface which is complementary to the outer diameter of feed pipe 4 and is solidly clamped thereon by bolts 23 and 24. A pin 106 (FIG. 5) extends between feed pipe 4 and band section 21 to prevent any possible rotation between body section 3 and feed pipe 4. Various types of sealing means may be mounted between the outer surface of feed pipe 4 and the inner surfaces of cylindrical band 20 to provide a liquid-tight seal therebetween. Feed pipe holes 8 are permanently aligned with holes 26 formed in lower band section 21 and with holes 19 formed in upper wall 17 and communicate with distribution chamber 15 to provide a flow path for the coating control fluid from pipe 4 into distribution chamber 15.

Upper closure portion 11 of fixed body section 3 includes a pair of vertically extending spaced plates 27 which are mounted on a base plate 28 that extends between a pair of cylindrical bands 20. Base plate 28 is mounted on a thickened top portion 29 of upper band section 22 by bolts 30 (FIGS. 4, 5 and 6).

Movable half body section 2 of nozzle 1 is generally similar to that of fixed body section 3 in that it includes a lower distribution chamber portion indicated generally at 33, and an upper closure loading clamping portion indicated generally at 34. Distribution chamber portion 33 includes a sloped transversely extending chamber forming wall 35 on which is mounted a lip wall 36 by a plurality of spaced bolts 37. Lip wall 36 terminates in a transversely extending lip 38 which together with lip 18 of lip wall 13 forms a nozzle discharge opening 39 which extends transversely throughout the length of nozzle 1. Chamber wall 35 and lip wall 36 form a distribution chamber 40 together with inner wall 41 and a top wall 42 (FIGS. 4 and 5).

Lower distribution chamber portion 33 is connected with upper closure portion 34 by a plurality of spaced cylindrical bands indicated generally at 44. Each band 44 is formed by a pair of semicylindrical band sections 45 and 46 (FIG. 4). Band sections 45 and 46 are similar to band sections 21 and 22 and are movably mounted on the outer circumference of feed pipe 4 by a plurality of bolts 47 which extend through abutting flanges 48 and 49 formed on band sections 45 and 46, respectively. The diameter of inner cylindrical surface 50 of band 44 formed by band sections 45 and 46 is slightly greater than the outer diameter of feed pipe 4 so as to provide a sliding pivotal movement therebetween. Various types of O-rings or sealing bushings (not shown) preferably are mounted between feed pipe 4 and interior surface 50 of each cylindrical band 44 to permit the sliding pivotal movement therebetween without appreciable leakage of fluid.

Feed pipe 4 communicates with distribution chamber 40 through spaced holes 7 formed in pipe 4 and through aligned holes 51 and 52 formed in lower band 45 and top distribution chamber wall 42, respectively. When the nozzle is open, holes 7 do not align with holes 51 as shown in FIG. 4.

Upper closure portion 34 includes a vertically extending plate 54 which extends upwardly from cylindrical band 44. Plate 54 is mounted on upper semicylindrical band section 46 by a plate 55 which is mounted on band section 46 by bolts 56 (FIGS. 4 and 6). Vertical plate 54 is mounted between spaced plates 27 of upper closure portion 11 and has a stop surface 57 formed at the top end thereof.

In accordance with one of the main features of the invention a plurality of improved closure loading clamping devices, each of which is indicated generally at 60, are mounted on improved nozzle 1. Devices 60 control the opening and closing movement of the nozzle body, regulate the size of discharge opening 39, and maintain nozzle opening 39 generally uniform throughout the transverse length of the nozzle body by reducing the amount of deflection of the nozzle body and lips caused by the internal pressure of the discharge fluid.

Each closure loading clamping device 60 is identical, therefore, only one is described in detail and shown in the drawings. Device 60 includes a fluid actuated cylinder 61 which is connected to a source of fluid, preferably pressurized air, by lines 62 and 62*a* for controlling the movement of a piston 63. Cylinder 61 is mounted between spaced plates 27 by a rod 64 which is mounted in a pair of end brackets 65 (FIG. 6). Brackets 65 are attached by setscrews 66 to plates 27. Piston 63 is connected to a U-shaped clevis 68 which is pivotally connected by a pin 69 to plate 54 of movable half body section 2.

An adjustable stop member indicated generally at 71, is mounted on the upper ends of plates 27 by a pair of plates 72 and 73. Plate 72 extends horizontally between vertical plates 27 and is attached thereto such as by welding. Plate 73 is attached by bolts 74 to plate 72 (FIG. 7) to clamp stop member 71 in supported position on plate 72.

Stop member 71 is an adjustable differential screw mechanism consisting of a fixed outer housing 75, an adjusting screw 76, and a striker screw 77. Adjusting screw 76 includes an exteriorly threaded cylindrical end portion 78 and an outer end portion 79 having flat surfaces formed thereon for engagement by an adjusting wrench or other mechanism for rotating screw 76. Striker screw 77 includes an outer striker end 80 and an exteriorly threaded shaft 81. Striker screw 77 also includes a square shaft section 108 riding in a square hole 109 in outer housing 75 to prevent rotation of screw 77. Shaft 81 is threadably engaged with an internal threaded bore 82 of adjusting screw 76. Exteriorly threaded end 78 of adjusting screw 76 is engaged with a threaded bore 84 of housing 75.

The use and operation of adjustable stop member 71 is well known in the art as a means of providing accurate adjustment for equipment and could be replaced with other types of adjusting mechanisms without affecting the concept of the invention. However, the particular configuration of an adjustable stop member 71 is preferred due to the accurate adjustments that can be achieved thereby. A pair of end seals 85 and 86 preferably are mounted in the ends of housing 75 and engageable with striker end 80 and adjusting screw 76, respectively.

FIGS. 8, 9 and 10 show a modified closure loading clamping device indicated generally at 90, which in certain coating applications and nozzle constructions will replace closure loading clamping device 60. A plurality of closure devices 90 will be spaced transversely along nozzle 1 as are closure devices 60 to reduce the amount of deflection of the nozzle lips due to the internal fluid pressure and to adjust the size of nozzle opening 39. Each closure device 90 is similar to each other, therefore, only one is shown in the drawings and described below.

Each closure device 90 includes a pair of base plates 91 and 92 mounted on fixed band 20 and movable band 44, respectively. A pair of pneumatic cylinders 61 are pivotally mounted by pins 93 on a pair of spaced posts 94 which are attached to fixed base plate 91 and extend vertically upwardly therefrom. Pistons 63 of cylinders 61 are connected to a pair of U-shaped clevises 68 which are pivotally mounted by pins 95 to a pair of posts 96 which are attached to movable base plate 92 and extend vertically upwardly therefrom.

An adjustable stop member 71 is mounted equidistant between cylinders 61 by a pair of plates 97 and 98 and bolts 99 on a vertically extending bracket 100 which is attached to base plate 92. Striker end 80 of adjustable stop member 71 is adapted to engage a stop 101 formed on the end of a vertically extending bracket 102 which is attached to fixed base plate 91. The operation of modified closure loading clamping device 90 is similar to that of closure device 60 which is described in detail below.

The operation of improved nozzle 1 and in particular that of the fluid feed arrangement of central pivot pipe 4 and of closure loading clamping devices 60 and 90 is as follows. Improved nozzle 1 is mounted by any of various types of mounting arrangements (not shown) which will enable the nozzle to be moved toward and away from a backup roll around which a moving substrate passes. The mounting arrangement also will enable the entire nozzle to be rotated to change the angle of impingement of the fluid discharge with respect to the substrate and for regulating the distance of nozzle opening 39 from the substrate. This mounting arrangement can have various configurations and constructions and forms no particular part of the present invention.

The coating control fluid is supplied to fluid feed pipe 4 through inlet ends 5 and 6 and will flow through pipe holes 7 and 8 (FIG. 11) and into distribution chamber 40 and 15 of half body sections 2 and 3, respectively. The control fluid will flow from chambers 15 and 40 through openings 104 and 105 formed in chamber walls 16 and 41, respectively, and into an elongated plenum 103 and then through nozzle discharge opening 39. A sealing strip 107 is mounted on inner wall 41 of distribution chamber 40 and extends throughout the transverse length of the nozzle and terminates in ends that extend downwardly along the edges of the nozzle (FIG. 1). The particular configuration of the nozzle distribution ends may have other configurations than that shown in the drawings, such as the distribution and fluid discharge arrangement shown in U.S. Pat. No. 3,314,163. Thus, during a usual coating control operation the fluid will follow the flow path described above through feed pipe 4 and into and out of distribution chambers 15 and 40 before being discharged through discharge opening 39.

In accordance with one of the features of the invention, a plurality of closure loading clamping devices 60 and/or 90 are spaced along the back of nozzle 1 which may have a transverse length of 250 inches or more. It is believed that a spacing of approximately 19 inches across the nozzle provides an extremely satisfactory construction which maintains nozzle opening 39 with a minimum and acceptable amount of deflection. Each closure device is adjusted initially by rotation of adjusting screw 76 of adjustable stop member 71. Rotational movement of screw 76 toward the stop surface 57 of plate 54 will result in striker screw 77 moving in the opposite direction away from stop 57. This enables movable half body section 2 to move toward a closed nozzle discharge position.

In a usual operating condition all of the individual closure devices are adjusted to the desired position wherein striker ends 80 engage stop surfaces 57 of vertical plate 54 and cylinders 61 have been pressurized to exert a force greater than the force exerted by the internal pressure of the control fluid within the nozzle body. An operator, as soon as detecting a streak developing in the coated material, will actuate a control circuit at a central control station which automatically reduces the closure force of cylinders 61 below that of the force generated by the internal nozzle fluid pressure. This internal fluid pressure will pivot half body section 2 about pivot pipe 4 a sufficient difference until counterbalanced by the weight of nozzle body section 2. This initial opening movement of the nozzle discharge opening has been found to be approximately 1/16 of an inch and will in many situations enable the dirt or foreign material causing the streak to be blown out or dislodged from the nozzle. If the dirt is dislodged, the operator merely releases the control button and pressurizes cylinders 61 which move pistons 63 in the direction of arrow A (FIG. 4) which will move nozzle lip 38 of movable body section 2 to its previous adjusted position due to stop surfaces 57 engaging striker ends 80. This procedure will take approximately two to five seconds and can be repeated several times to remove the streak-causing materials eliminating further more time-consuming cleaning operations.

If the streak still remains after this initial action on the part of the operator, the nozzle is retracted for full cleaning by the particular nozzle mounting arrangement and is rotated to an open position such as shown in FIG. 4. The streak-causing particles then are wiped from the nozzle lips which may take slightly longer in contrast to the above-described automatic cleaning operation. Even after nozzle 1 has been opened to a full cleaning position, the closure devices enable nozzle discharge opening 39 to be returned to its previously adjusted gap setting since pressurizing of cylinders 61 will automatically pivot movable body section 2 to its previously adjusted position by the engagement of stop surfaces 57 with striker ends 80 of adjustable stop members 71.

Another feature of the improved nozzle construction is the ability to change and control the size of discharge opening 39 even during a coating operation without materially affecting the same. This adjustment is accomplished by rotating adjusting screws 76 of adjustable stop members 71 by a tool engaged with screw ends 79. Again, depending upon the particular rotational direction of screws 76, striker screws 77 will either move toward or away from stop surfaces 57 enabling movable body section 2 to increase or decrease the size of discharge opening 39.

Adjustment of all adjustable stop members along the transverse length of nozzle 1 will enable the discharge opening to be adjusted throughout the entire length of the nozzle. However, if only a certain section of the nozzle opening requires adjustment, the same can be accomplished by adjusting only those closure loading clamping devices mounted in the vicinity of the discharge opening desired to be adjusted. Therefore, even repeated opening and closing of the nozzle discharge opening will not affect the predetermined and preset size of the discharge opening due to the engagement of stop surfaces 57 with striker ends 80. So long as the force exerted by cylinders 61 is greater than the force generated by the internal pressure of the discharge fluid acting on nozzle body 2 attempting to pivot it to an open position, the nozzle lips will maintain their preset adjusted position.

In accordance with one of the main features of the invention each closure loading clamping device 60 and its associated adjustable stop member 71 effectively act in a common plane indicated at 110 in FIGS. 1, 2 and 6 which is perpendicular to the transversely extending fluid supply pipe 4 and nozzle discharge opening 39. Likewise, the effective force exerted by the pair of cylinders 61 of each modified closure loading clamping device 90 lies in an imaginary plane 111 which aligns with its associated stop member 71 as shown in FIG. 8. It is this relationship between closure devices 60 and 90 and stop members 71 which reduces distortion on the nozzle body and lips as occurs in prior nozzle constructions.

Accordingly, the improved nozzle construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved nozzle construction for coating equipment is constructed and used, the characteristics of the construction, and the advantageous, new and useful results obtained; the new and useful structures, devices, elements, arrangements, parts, and combinations, are set forth in the appended claims.

We claim:

1. An improved fluid nozzle construction for coating equipment including: a transversely elongated nozzle body having a first moveable section, and a second fixed section forming a transversely elongated discharge opening for discharging a stream of fluid on a moving substrate, said second section having a transversely extending hollow conduit providing a fluid supply pipe adapted to be connected to a source of fluid pressure for supplying fluid to the nozzle body for discharge through the elongated discharge opening; pivot means for pivotally mounting the moveable section on the hollow conduit of the fixed section; and a plurality of pressure means mounted on and spaced along the fixed section and acting on the moveable section for moving said section with respect to the fixed section to vary the size of the discharge opening, and to limit and control the deflection of the first section with respect to the second section.

2. The fluid nozzle construction defined in claim 1 in which stop means are mounted on the fixed section for engagement with the moveable section for limiting the pivotal movement of the moveable section with respect to the fixed section to define the size and transverse shape of the discharge opening.

3. The fluid nozzle construction defined in claim 2 in which each of the sections include a pair of converging walls forming a fluid pressure distribution chamber therebetween; and in which said fluid pressure distribution chambers are spaced from each other and form a plenum therebetween which communicates with the fluid discharge opening.

4. The fluid nozzle construction defined in claim 3 in which holes are formed in at least one of the plenum defining walls to allow fluid to pass from the distribution chamber into the plenum.

5. An elongated fluid nozzle construction including:

(a) a transversely elongated nozzle body having first and second sections, said sections having lip walls forming a transversely elongated discharge opening for discharging a stream of fluid against a moving substrate;

(b) a transversely extending fluid supply pipe adapted to be connected to a fluid supply for supplying fluid to the nozzle body for discharge through the discharge opening;

(c) the second nozzle body section being fixed on the fluid supply pipe with the first nozzle body section being pivotally mounted on said supply pipe for adjusting the size of the nozzle discharge opening; and (d) means mounted on the nozzle body and operatively engageable with the first and second body sections for adjusting the size of the nozzle discharge opening and for maintaining said nozzle opening in the adjusted position.

6. The nozzle construction defined in claim 5 in which a plurality of spaced holes are formed in the fluid supply pipe; in which certain of said holes communicate with a fluid distribution chamber formed in a lower end of the first body section; and in which other of said holes communicate with a fluid distribution chamber formed in a lower end of the second body section.

7. The nozzle construction defined in claim 5 in which each of the body sections forms one half of the nozzle body and are generally similar to each other; and in which each body section is formed with a fluid distribution chamber at a lower end of the body section which communicates with the fluid supply pipe and the nozzle discharge opening formed by the lip walls which are mounted on the fluid distribution chamber ends of the body sections.

8. The nozzle construction defined in claim 7 in which the means for adjusting and maintaining the size of the discharge opening includes at least one fluid actuated closure cylinder and at least one adjusting screw member; in which the cylinder and screw member are mounted on and engageable with upper ends of the body sections; and in which the closure cylinder and screw member effectively act in a common plane perpendicular to the transversely extending fluid supply pipe.

9. An improved fluid nozzle construction for coating equipment including:

(a) a transversely elongated nozzle body having first and second sections forming a transversely elongated discharge opening for discharging a stream of fluid on a moving substrate, each of said sections include a lower fluid distribution portion and an upper closure portion;

(b) transversely extending pivot means for pivotally mounting the first body section with respect to the second body section, said pivot means being located intermediate the upper and lower portions of said body sections;

(c) closure means operatively engageable with the first body section for moving said first body section with respect to the second body section about the pivot means to vary the size of the discharge opening;

(d) adjustable stop means for limiting the pivotal movement of the first body section with respect to the second body section to define the size of the discharge opening; and (e) the closure means and stop means effectively acting in a common plane perpendicular to the transversely extending pivot means.

10. The nozzle construction defined in claim 9 in which the adjustable stop means includes a screw movably mounted on the upper portion of the second body section and engageable with the upper portion of the movable first body section to limit the movement of said first body section when moving toward a closed nozzle position.

11. The nozzle construction defined in claim 9 in which each of the upper and lower portions of the body sections is formed with a semicylindrical opening, which openings are aligned with each other to form a cylindrical opening; and in which the transversely extending pivot means is a cylindrically shaped fluid supply pipe and is telescopically mounted in the cylindrical opening formed by the body sections.

12. The nozzle construction defined in claim 9 in which the closure means includes a fluid actuated cylinder which is mounted on the upper closure portion of the second body portion; and in which the cylinder includes a piston engaged with the upper portion of the movable first body section for moving said first body section on the transversely extending pivot means to adjust the size of the discharge opening.

13. The nozzle construction defined in claim 9 in which the closure means is adapted to exert a force on the first body section in a nozzle closing direction greater than the force exerted on said first body section by the fluid pressure within the nozzle in an opening direction.

14. The nozzle construction defined in claim 9 in which the stop means includes a differential screw permitting fine adjustment of the nozzle discharge opening.

15. The nozzle construction defined in claim 9 in which the pivot means includes a fluid supply pipe adapted to be connected to a source of fluid pressure.

16. The nozzle construction defined in claim 9 in which the closure means includes a pair of fluid actuated cylinders supported on a pair of spaced brackets which are mounted on the fixed second body section of the nozzle body; and in which the adjustable stop means includes a screw movably mounted on one of the body sections; and engageable with a stop member formed on the other of the body sections.

17. The nozzle construction defined in claim 9 in which the coating control fluid is air; and in which the closure means includes pneumatically operated cylinders.

18. The nozzle construction defined in claim 9 in which a fluid distribution chamber is formed in each of the lower portions of the body sections and are adapted to communicate with a supply of fluid; in which said lower portions terminate in lip walls which form the elongated discharge opening; and in which the distribution chambers communicate with the discharge opening for supplying a stream of fluid through said discharge opening against a moving substrate.

19. The nozzle construction defined in claim 18 in which the pivot means includes a fluid supply pipe; in which said fluid supply pipe is formed with openings which communicate with the fluid distribution chambers; and in which said supply pipe is adapted to communicate with a supply of fluid for distributing the fluid through said openings and into the distribution chambers.

20. The nozzle construction defined in claim 19 in which the upper and lower body portions are mounted on the fluid supply pipe by annular bands.

21. The nozzle construction defined in claim 9 in which a plurality of closure means and stop means are mounted on and spaced along the nozzle body to provide a substantially uniform nozzle discharge opening across the transverse length of the nozzle.

22. The nozzle construction defined in claim 21 in which each of the closure means includes a fluid actuated cylinder; in which the closure means cylinders are actuated simultaneously by a source of compressed fluid; and in which the force exerted by each of the cylinder means in a closing direction is greater than the force exerted by the internal nozzle pressure exerted on the body sections of the nozzle by the supply of coating control fluid in the distribution chambers in a zone adjacent each of said cylinders.

23. An improved fluid nozzle construction for coating control equipment including:

(a) a coating control fluid supply pipe;

(b) a nozzle body formed by two half-sections, one of said half-sections being fixedly mounted on the fluid supply pipe and the other of said half-sections being movably mounted on said supply pipe to regulate a fluid discharge opening formed by nozzle lips mounted on lower ends of said two half-sections;

(c) fluid distribution chamber means formed in each of the body half-sections and communicating with the fluid supply pipe and with the fluid discharge opening for passing fluid from the supply pipe to the discharge opening;

(d) closure means mounted on the nozzle body for moving the nozzle lip of the movable half-section toward the nozzle lip of the fixed half-section; and (e) adjustable stop means mounted on the nozzle body and engageable with the two half-sections for limiting movement of the movable half-section by the closure means to a predetermined position to regulate the size of the nozzle discharge opening.

24. A transversely elongated gaseous fluid nozzle including:

(a) first and second sections moveable between an open position and a working position, and forming a plenum and a transversely elongated adjustable discharge opening when in the working position for discharging a stream of gaseous fluid against a moving substrate;

(b) the second section having a hollow conduit and a pair of converging walls rigidly mounted on said conduit forming a fluid pressure distribution chamber therebetween; and with a discharge opening forming lip being mounted on one of said converging walls and with one of said converging walls forming one wall of the plenum;

(c) the first section having a pair of converging walls rigidly attached to each other and forming a fluid distribution chamber therebetween, and with said walls being pivotally mounted on the second section; and with a discharge opening forming lip being mounted on one of said converging walls and with one of said converging walls being spaced from the plenum forming wall of the first section to form the plenum therebetween;

(d) a plurality of reversible pressure actuated moveable closure means and stop means spaced along the nozzle and acting in cooperation with each other for limiting the movement of the pressure means in the closing direction to determine the size of the discharge opening and to resist the internal pressure exerted on the plenum forming walls by the gaseous fluid within the plenum;

(e) holes formed in the plenum forming walls providing communication between the plenum and fluid distribution chambers; and (f) mating opening means formed in the hollow conduit and one of said sections for supplying pressurized fluid from the conduit into the fluid chamber of said section for discharge into the plenum through the associated plenum wall holes.

* * * * *